US010982510B2

(12) United States Patent
Bridges et al.

(10) Patent No.: US 10,982,510 B2
(45) Date of Patent: Apr. 20, 2021

(54) SUBASSEMBLY FOR A BOTTOM HOLE ASSEMBLY OF A DRILL STRING WITH A POWER LINK

(71) Applicant: Enteq Upstream USA Inc., Houston, TX (US)

(72) Inventors: Andrew Bridges, Houston, TX (US); Raymond Garcia, Houston, TX (US)

(73) Assignee: Enteq Upstream USA Inc., Houston, TX (US)

( * ) Notice: Subject to any disclaimer, the term of this patent is extended or adjusted under 35 U.S.C. 154(b) by 354 days.

(21) Appl. No.: 15/895,230

(22) Filed: Feb. 13, 2018

(65) Prior Publication Data

US 2018/0230779 A1 Aug. 16, 2018

Related U.S. Application Data

(60) Provisional application No. 62/459,112, filed on Feb. 15, 2017.

(51) Int. Cl.

| | |
|---|---|
| ***E21B 41/00*** | (2006.01) |
| ***E21B 47/12*** | (2012.01) |
| ***E21B 17/16*** | (2006.01) |
| ***E21B 47/01*** | (2012.01) |
| ***E21B 47/26*** | (2012.01) |

(Continued)

(52) U.S. Cl.

CPC ..... *E21B 41/0085* (2013.01); *E21B 17/16* (2013.01); *E21B 41/00* (2013.01); *E21B 47/01* (2013.01); *E21B 47/12* (2013.01); *E21B 47/26* (2020.05); *E21B 47/06* (2013.01); *E21B 49/00* (2013.01)

(58) Field of Classification Search

CPC combination set(s) only.
See application file for complete search history.

(56) References Cited

U.S. PATENT DOCUMENTS

| | | | |
|---|---|---|---|
| 4,806,928 | A | 2/1989 | Veneruso |
| 6,427,783 | B2 | 8/2002 | Krueger et al. |

(Continued)

FOREIGN PATENT DOCUMENTS

| | | | |
|---|---|---|---|
| WO | 2014080178 | A2 | 5/2014 |
| WO | 2015192226 | A1 | 12/2015 |

OTHER PUBLICATIONS

Intellectual Property Office, Search and Examination Report in GB1703392.9, dated Jun. 15, 2017.

(Continued)

*Primary Examiner* — Cathleen R Hutchins
*Assistant Examiner* — Ronald R Runyan
(74) *Attorney, Agent, or Firm* — Wood Herron & Evans LLP

(57) ABSTRACT

A subassembly for a bottom hole assembly of a drill string, the subassembly comprising: a tubular portion having a wall for supporting one or more sensors and an inner surface defining a longitudinal bore; a probe assembly comprising a main body, the probe assembly being removably located in the bore and positioned such that a flow channel for drilling fluid is defined between the inner surface of the tubular portion and the probe assembly. A power link for transferring electrical power between the probe assembly and a sensor supported by the tubular portion.

20 Claims, 8 Drawing Sheets

(51) Int. Cl.
*E21B 47/06* (2012.01)
*E21B 49/00* (2006.01)

(56) References Cited

U.S. PATENT DOCUMENTS

| | | | | |
|---|---|---|---|---|
| 6,540,032 | B1 * | 4/2003 | Krueger | E21B 17/028 175/40 |
| 7,336,199 | B2 | 2/2008 | Lasater et al. | |
| 8,810,428 | B2 | 8/2014 | Madhavan et al. | |
| 9,217,299 | B2 | 12/2015 | Moriarty et al. | |
| 9,245,683 | B2 | 1/2016 | Zhao et al. | |
| 9,347,277 | B2 | 5/2016 | Taherian et al. | |
| 9,464,489 | B2 | 10/2016 | MacDougall et al. | |
| 10,301,931 | B2 | 5/2019 | Derkacz et al. | |
| 10,358,909 | B2 | 7/2019 | Bittar et al. | |
| 2009/0085701 | A1 | 4/2009 | Veneruso et al. | |
| 2010/0081483 | A1 * | 4/2010 | Chatterjee | H01F 1/15333 455/572 |
| 2012/0001629 | A1 * | 1/2012 | Hopper | G01R 33/3607 324/303 |
| 2013/0181536 | A1 * | 7/2013 | Bhargawa | H02J 50/12 307/104 |
| 2013/0181799 | A1 | 7/2013 | Deville et al. | |
| 2015/0167466 | A1 | 6/2015 | Teodorescu et al. | |
| 2016/0349782 | A1 * | 12/2016 | Tsai | H02J 50/80 |
| 2019/0024462 | A1 | 1/2019 | Sugiura et al. | |

OTHER PUBLICATIONS

Intellectual Property Office, Search and Examination Report in GB1802416.6, dated Jun. 28, 2018.
Intellectual Property Office, Search and Examination Report in GB1703393.7, dated Jun. 15, 2017.

* cited by examiner

SUBASSEMBLY FOR A BOTTOM HOLE ASSEMBLY OF A DRILL STRING WITH A POWER LINK

The present invention relates to a subassembly for a bottom hole assembly of a drill string. In particular, the present invention relates to a subassembly for a bottom hole assembly of a drill string, the subassembly having a tubular portion, an electronic probe assembly separated from the tubular portion by a flow channel, and a power link for transferring power between the probe assembly and sensors supported by the tubular portion. The present invention also relates to a method of transferring power in a bottom hole assembly of a drill string.

Wellbores are generally drilled using a drilling string formed of a number of drill pipes connected end to end which extends from the surface to a bottom hole assembly (BHA) at its terminal end. The bottom hole assembly (BHA) in an oil well drilling string typically consists of a drill bit at the bottom, and above that a motor and power section. The power section is essentially a turbine that extracts power from the flow of drilling mud pumped from the surface and rotates the drill bit. Above the power section there are typically a number of heavy drill collars that add mass to the bottom hole assembly. These contain a central bore to allow the flow of drilling mud through to the power section. The wellbore is drilled by the BHA in order to reach a subterranean formation of interest which may then be assessed, for example to determine whether hydrocarbons may be present in the formation.

Initially, wellbores were drilled without any form of directional monitoring while drilling. Instead, sections of wells were surveyed after they had been drilled, by which time they could easily have deviated significantly from their intended path. To address this problem, Measurement While Drilling (MWD) equipment was introduced using accelerometers and magnetometers to determine the orientation of the drill string during drilling. This information could be conveyed to the surface in real time, usually in the form of pressure pulses in the drilling mud column pumped from the surface.

MWD equipment is typically contained in a small diameter probe assembly that sits within a drill collar such that an annular space exists between the probe assembly and the drill collar to allow the passage of drilling mud around the probe assembly and down to the power section. In some examples, the probe assembly is supported within the drill collar with centralisers at the base of the probe assembly and higher up. The centralisers usually consist of rubber fins or metal bow springs and support the probe assembly such that an annular space exists between the probe assembly and the drill collar to allow the passage of drilling mud around the probe assembly and down to the power section. Typically, the probe assembly is seated in its support such that it is held to a specific rotation but is not otherwise fixed relative to the drill collar. This allows the probe assembly to be removed from the BHA by lowering a cable assembly down the inside of the drill pipe and collars, attaching it to the top of the probe and hoisting it back to the surface. This operation may be performed, for example to replace batteries or faulty equipment in the probe, without the need to remove the BHA, collars and all the drill pipe from the well, which is a very time-consuming process. Once the batteries or faulty equipment have been replaced the probe assembly may be lowered back into the BHA and drilling may recommence. This retrievability and reseatability is viewed in the industry as very desirable.

In addition to the presence of MWD equipment in the probe assembly to determine the orientation of the drill string, additional sensors, such as natural gamma ray sensors and shock and vibration monitors, may also be included in the probe assembly and their data included in the data stream sent to the surface. These sensors may allow measurements relating to the properties of a formation to be transmitted to the surface while drilling is taking place, or in "real-time". Such Logging While Drilling (LWD) equipment allows measurement results to be obtained before drilling fluids invade the formation deeply and may allow measurements to be obtained from the formation in the event that subsequent wireline operations are not possible.

However, the probe assembly is not the ideal location for all sensors, and there is often a desire or need to locate sensors in other parts of the bottom hole assembly. For example, some sensors, such as bore pressure sensors and formation resistivity sensors, need access to the borehole surrounding the drill collar and, therefore, must be mounted on an outer surface of a drill collar.

However, this comes with the sacrifice of not being able to retrieve said sensors in the event that their batteries or other components fail, without also needing to remove the BHA, collars and all the drill pipe from the well.

Furthermore, it is sometimes desirable to mount these additional sensors below the MWD probe and therefore closer to the drill bit. Many MWD systems employ a bottom-mount pulser for transmitting measured data to the surface. The lower section of such a pulser is entirely mechanical and provides no means of routing through wires. This makes any form of connection to such equipment below the pulser extremely difficult.

Accordingly, it would be desirable to provide a solution for powering such drill collar mounted sensors in a manner that would minimise disruption and downtime, and without compromising desirable aspects of the probe assembly, such as the retrievability of the probe assembly.

According to a first aspect of the present invention there is provided a subassembly for a bottom hole assembly of a drill string, the subassembly comprising: a tubular portion having a wall for supporting one or more sensors and an inner surface defining a longitudinal bore; a probe assembly comprising a main body, the probe assembly being removably located in the bore and positioned such that a flow channel for drilling fluid is defined between the inner surface of the tubular portion and the probe assembly; and a wireless power link for transferring electrical power between the probe assembly and a sensor supported by the tubular portion. The wireless power link includes: a probe coil forming part of the probe assembly and connected to a probe power source line; a first magnetic flux guide disposed between the probe coil and the probe assembly; a tubular portion coil forming part of the tubular portion and connected to a sensor power line; and a second magnetic flux guide disposed between the tubular portion coil and the inner wall of the tubular portion. The probe coil and the tubular portion coil are positioned such that an inductive circuit is formed across the flow channel between the probe coil and tubular portion coil to allow power transfer between the probe power source line and the sensor power line using the inductive circuit. The power source line may be supplied with power from a power source in the probe assembly, such as a battery. Alternatively, the power source line may be supplied with power from an electrical generator.

With this arrangement, there is no requirement for any electrical connectors to be used between the probe assembly and the tubular portion. Instead, the sensor can be powered wirelessly by way of inductive coupling between the probe coil and tubular portion coil. This allows the probe assembly to be retrieved from and reseated in the tubular portion bore even when used with a collar-mounted sensor located outside of the tubular portion. It may also be of particular benefit when the drill collar is used with a water-based drilling mud, which is highly conductive, since the mud could short-circuit any electrical connectors provided between the probe assembly and the tubular portion. It has also been found that the provision of the first and second magnetic flux guides enables an efficient transfer of sufficiently high power levels for the types of sensors that may be required in such an environment.

The probe assembly is removably located in the bore. This means that the probe assembly is not secured to the tubular portion, but rests within the tubular portion such that it can be retrieved from above and independently of the tubular portion. For example, the probe assembly may rest against one or more stops in the tubular portion such that the probe assembly is located in the bore only under the action of its own weight.

As used herein, the term "tubular portion" refers to an open-ended and hollow structure which is intended to form part of the flow path for drilling mud through the bottom hole assembly. For example, the tubular portion may be a collar or a sub which is intended to define an outer surface of the bottom hole assembly such that it forms part of the length of the bottom hole assembly. In such examples, the term "subassembly" refers to a combination of the collar or sub and the probe assembly. Alternatively, the tubular portion may be a sleeve or insert which is intended for insertion into a collar or sub of the bottom hole assembly. In such examples, the term "subassembly" refers to a combination of the sleeve and the probe assembly.

Preferably, one or both of the first magnetic flux guide and second magnetic flux guide is formed from a ferrite material. Ferrite material is a particularly preferred form of magnetic flux guide, and particularly for embodiments in which the coils are operated at higher frequencies (such as around 100 kHz), as they produce little eddy current losses, in comparison to the likes of laminated iron magnetic flux guides. This is particularly important in the present invention, as the requirement for a flow space or channel for drilling fluid to flow between the probe assembly and the tubular portion means that a single continuous magnetic flux guide looped through both coils is not possible.

The ferrite material may be a medium permeability power grade Zinc-Manganese composition. Such material may have a Curie temperature of at least 200 degrees centigrade.

Preferably, the ferrite material has a thickness of at least about 1 mm. Preferably, the ferrite material has a thickness of less than about 5 mm. In some embodiments, the thickness of the ferrite material is about 2 mm.

The probe coil and the tubular portion coil are positioned relative to one another in the subassembly such that an inductive circuit is formed across the flow channel between the probe coil and tubular portion coil.

In a first set of preferred embodiments, this may be achieved by arranging for the probe coil to be wound around the outer surface of the main body of the probe assembly, and the tubular portion coil to be wound around the inner surface of the tubular portion. In such embodiments, the coils may share a single common magnetic axis. This may help to improve the inductive coupling between the coils. In such embodiments, the tubular portion coil and the probe coil may be wound such that they protrude into the flow channel. In other examples, one or both of the tubular portion and the main body of the probe assembly comprises a recess in which its respective coil is located. The tubular portion recess may be formed by a radial groove on its inner surface in which the tubular portion coil is wound, and the probe assembly recess may be formed by a radial groove on the outer surface of the main body of the probe assembly in which the probe coil is wound.

In a second set of preferred embodiments, the probe coil may instead be disposed adjacent to the main body of the probe assembly and the tubular portion coil disposed adjacent to the inner surface of the tubular portion. In such embodiments, the magnetic axes of the tubular portion coil and the probe coil are preferably parallel but radially spaced from each other. The probe coil may be fixed relative to the main body of the probe assembly by disposing the probe coil in a housing that is attached to the main body of the probe assembly, and the tubular portion coil may be fixed relative to the inner surface of the tubular portion by disposing the tubular portion coil in a housing that is attached to the inner surface of the tubular portion. In such examples, the housings will protrude into the flow channel for the drilling fluid. However, preferably, in the second set of preferred embodiments, the tubular portion comprises a recess on its inner surface in which the tubular portion coil is located, and the main body of the probe assembly comprises a recess on its outer surface in which the probe coil is located.

Accordingly, in both the first and second sets of preferred embodiments, the tubular portion preferably comprises a recess on its inner surface in which the tubular portion coil is located, and the main body of the probe assembly preferably comprises a recess on its outer surface in which the probe coil is located. With this arrangement, the coils are recessed into the main body of the probe assembly and the tubular portion to provide protection from damage or dislodgement due to the flow of drilling mud.

Where the coils are provided in respective recesses, the first magnetic flux guide is disposed between the probe coil and the inner surface of the probe assembly recess, and the second magnetic flux guide is disposed between the tubular portion coil and the inner surface of the tubular portion recess.

The recesses may be exposed at their openings. Alternatively, one or both of the recesses may be provided with a cover extending over its opening to seal the recess from drilling fluid. Preferably, each of the recesses is provided with a cover extending over its opening to seal the recess from drilling fluid.

With this arrangement, the coils are isolated from the drilling fluid by the covers. This means that the coils can be used with conductive drilling fluid, such as water-based drilling fluid without the risk of shorting of the coils by the drilling fluid. This, coupled with the fact that there is no direct electrical or mechanical connection between the probe assembly and the tubular portion equipment, also means that the probe assembly can be removed from the tubular portion without exposing any electrical wiring. This differs from some known systems in which releasable electrical connectors are used to form an electrical connection between the probe assembly and a collar-mounted sensor. Such connectors may be short circuited by water-based drilling fluid unless additional seals, such as O-rings, are provided. Where additional seals are provided, these may increase the difficulty with which the electrical connection is re-established and may not perform well in the presence of particulates, such as sand, in the drilling fluid which can prevent an adequate seal from being formed.

The covers are preferably non-magnetic.

Where the recesses are sealed using covers, the recesses may contain a non-conductive fluid to assist with the sealing of the recesses from the drilling fluid.

The covers may be configured to seal the recesses against pressures experienced during operation. For example, the covers may be configured to seal the recesses against a pressure of 1,400 atmospheres.

The probe and tubular portion covers are preferably non-magnetic and preferably non-conductive. Where the recesses are sealed using covers, the recesses may contain a non-conductive fluid to assist with the sealing of the recesses from the drilling fluid. Preferably, one or both of the radial recesses contains oil to assist with the sealing of the groove from the drilling fluid. The covers are preferably configured to seal the recesses against pressures experienced during operation. For example, the covers may be configured to seal the recesses against a pressure of 1,400 atmospheres.

Preferably, the magnetic flux guides are spaced from their respective adjacent parts of the probe assembly and tubular portion. That is, preferably, the first magnetic flux guide is spaced from an outer surface on the main body of the probe assembly by a clearance of at least about 0.5 mm, preferably at least about 1 mm. Preferably, the first magnetic flux guide is spaced from an outer surface on the main body of the probe assembly by a clearance of no more than about 7 mm, preferably of no more than about 5 mm.

Alternatively or additionally, preferably, the second magnetic flux guide is spaced from the inner surface of the tubular portion by a clearance of at least about 0.5 mm, preferably at least about 1 mm. Preferably, the second magnetic flux guide is spaced from the inner surface of the tubular portion by a clearance of no more than about 7 mm, preferably of no more than about 5 mm.

Preferably, the tubular portion coil is connected to a power receiver electric circuitry that would include analog to digital converters, power control, amplifiers, comparators, timing, data clock and flow detection along with data management logic, configured to operate the tubular portion coil as a receiver coil, and wherein the probe coil is connected to power transmitter electric circuitry configured to operate the probe coil as a transmitter coil. In this manner, power can be transferred from the probe assembly to an external sensors connected to the tubular portion coil, via the inductive circuit and the sensor power line. Power may also be transferred in the opposite configuration of drill collar power line to probe power line via the drill collar and probe coils.

The probe coil is connectable to a probe power line and the tubular portion coil is connectable to a sensor power line. In each case, the coil may be connected via a standard electrical interface or data transfer mechanism, forming part of the subassembly. For example, suitable standard interfaces include, but are not limited to, RS-232, RS-422 and RS-485.

To enhance the efficiency of power transfer, a resonant circuit may be included in the power transmitter electric circuitry of the probe coil, or may be included in the power receiver electric circuitry of the tubular portion coil, or may be included in both the power transmitter electric circuitry of the probe coil and the power receiver electric circuitry of the tubular portion coil.

Whilst a resonant circuit may be included in the circuitry of both coils, it is preferably for a resonant circuit to only be included in one of the coils. This is because this can reduce the amount of additional electronic components needed, without any significant detrimental effect on the benefits of having a resonant circuit present in the system.

The resonant circuit may be included in the power transmitter electric circuitry of the probe coil. However, preferably, the circuitry for the receiving coil is the one that contains the resonant circuit. That is, preferably the power receiver electric circuitry of the tubular portion coil comprises a resonant circuit configured to tune the tubular portion coil to a drive frequency of the probe coil. Resonating the receiving coil may be preferable to resonating the driving coil because it can lead to a significantly more stable output voltage, which is less affected by load. Indeed, any variations with load occurring at the receiving coil can be accommodated by using a linear power supply, or may be tolerated by the circuitry that the receiving coil powers without requiring any additional conditioning. The linear power supply may have a stable and tightly controlled input voltage to operate efficiently.

Furthermore, if the driving coil were to be resonated, rather than the receiving coil, the voltage across the driving coil would be significantly higher, leading to a higher current across the resonant circuit regardless of load. This can be problematic when used in a bottom hole assembly where the components of the wireless power link are required to be relatively small in size, because, with such components, the relatively high currents would lead to undesirably high resistive loses and poor efficiencies.

In contrast, if the receiving coil is instead resonated, then relatively high currents may only flow in response to—and in proportion to—the power demanded by components to which the receiving coil is connected, such as the one or more externally mounted sensors. This is particularly advantageous when one or more batteries are used as the power supply for powering the wireless power link, because a lower power draw will result in longer battery life and therefore longer use time for the system. This is clearly important in the context of bottom hole assemblies, where retrieval of the probe coil for battery replacement can be complex and time consuming.

The probe coil may be configured to drive the tubular portion coil with a square wave drive signal or a sinusoidal wave drive signal. A square wave drive signal may be preferable because it can be created by alternating the drive voltage between the power supply voltage and ground. This may be relatively simple to implement and may be more power efficient, for example in comparison to a sinusoidal drive signal, because minimal power would be dissipated in a switching circuit used to create the square wave signal. For example, with a sinusoidal drive signal, the voltage that the transmitter or driving coil needs to generate may be anywhere between its power supply voltage and ground. To achieve a certain desired voltage the transmitter may therefore need to drop the portion of the power supply voltage that is not needed, and thereby dissipate power locally. This can lead to increased temperatures at the transmitter or driving coil, which may be particularly problematic in a wellbore environment. Furthermore, such local power dissipation may also result in a lower power efficiency at the transmitter or driving coil, as well as reduced battery lifetimes. A square wave drive signal is therefore preferable because it can allow for simplified drive circuitry to be used and can achieve a higher efficiency than other drive waveforms.

The resonant circuit may help to maintain a sinusoidal current or square wave current flow across the output of the power receiver electric circuitry of the tubular portion coil. The resonant circuit may comprise one or more capacitors placed in series with the tubular portion coil and other electronic circuitry. Preferably, the power receiver electric circuitry further comprises a pair of bulk storage capacitors, and said capacitors may be configured to charge on opposite half cycles of an oscillating drive signal received by the tubular portion coil.

Preferably, the tubular portion coil and the probe coil are closely aligned in the longitudinal direction subassembly. That is, preferably, the centre of the tubular portion coil is aligned with the centre of the probe coil, in the longitudinal direction subassembly. This can help to optimise the efficiency of power transfer between the coils. However, it has been found that the arrangement of the present invention can still be efficient in transferring power to one or more externally mounted sensors, even if there is an off-set or misalignment between the tubular portion coil and the probe coil. In particular, it has been found that the present invention can still function efficiently, even with a misalignment is 30 mm or more in the longitudinal direction of the subassembly. That is the centre of the tubular portion coil can be positioned within 30 mm of the centre of the probe coil (in the longitudinal direction of the subassembly), and an efficient transfer of sufficiently high power levels for the types of sensors that may be required in such an environment can still be achieved. This can be helpful when there are restrictions on where the two coils can be located in subassembly.

Accordingly, preferably, the tubular portion coil is disposed within 30 mm of the probe coil in the longitudinal direction subassembly. That is, preferably, the centre of the tubular portion coil is disposed within 30 mm of the centre of the probe coil in the longitudinal direction of the subassembly.

The probe coil and the tubular portion coil may be spaced from their respective magnetic flux guides by nothing more than an air gap. In some embodiments, an insulating material is disposed between the probe coil and the first magnetic flux guide; and/or an insulating material disposed between the tubular portion coil and the second magnetic flux guide. The insulating material may have a thickness of between about 1 mm and about 10 mm.

In some preferred embodiments the probe coil abuts the first magnetic flux guide. In some preferred embodiments, the first magnetic flux guide abuts the main body of the probe assembly. Alternatively or additionally, the tubular portion coil may abut the second magnetic flux guide and/or the second magnetic flux guide may abut the inner surface of the tubular portion. Arranging for respective abutment between the coils, flux guides and probe assembly or tubular portion can help to reduce the overall space occupied by the wireless power link.

The probe coil may have any suitable number of turns (Np), and the tubular portion coil may have any suitable number of turns (Nc). Consequently, the ratio of Np to Nc may have any suitable value. However, it has been found that a particularly efficient transfer of power can be provided in the present invention when the number of turns in the tubular portion coil is approximately similar to the number of turns of the probe coil. Accordingly, preferably the number of turns in the tubular portion coil is within 5 percent of the number of turns of the probe coil, more preferably wherein the number of turns in the tubular portion coil is the same as the number of turns of the probe coil. In some embodiments, the number of turns in each coil is at least about 40.

The inductive circuit formed by the tubular portion coil and the probe coil may have a coupling coefficient (k) of between 0 and 1. Preferably, the inductive circuit formed by the tubular portion coil and the probe coil has a coupling coefficient (k) of at least about 0.3, more preferably of at least about 0.5, even more preferably at least about 0.8. The coupling coefficiency can be increased through the inclusion of the first and second magnetic flux guides, and by adjusting the properties of said magnetic flux guides. The coupling coefficiency may also be improved by increasing the number of turns in each coil, and by arranging for the number of turns in the tubular portion coil to be approximately similar to the number of turns of the probe coil. The coupling coefficiency has little to no bearing on the efficiency of power transfer, but a low coupling coefficient will give a low output voltage for any given input voltage. Accordingly, by having a relatively high coupling coefficiency, the present invention is able to ensure that a sufficiently high out voltage is achieved at the tubular portion coil, and consequently, sufficient power is provided to the sensor power line.

The probe coil may be powered by a battery or a downhole power generator. The tubular portion coil may be powered by a battery or a downhole power generator. The probe coil and the tubular portion coil may each be independently powered by a battery or a downhole power generator.

Preferably, the probe coil and the tubular portion coil are both tuned to a frequency of about 200 kHz or less, more preferably of about 150 kHz or less. The tuned frequency may be at least about 50 KHz. In some preferred embodiments, the probe coil and the tubular portion coil are both tuned to a frequency of from about 75 kHz to about 125 kHz, more preferably of about 100 kHz.

The subassembly may comprise one or more sensors mounted on or in the wall of the tubular portion and a sensor power line connected to the one or more sensors.

The subassembly may comprise one or more sensors mounted on or in the wall of the tubular portion and a sensor power line connected to the one or more sensors. Power may then be transferred between the probe assembly and the sensor using the wireless power link. The subassembly may comprise a plurality of sensors mounted on or in the wall of the tubular portion. The sensors may each be connected to the wireless power link by the sensor power line. The collar-mounted sensors may each be connected to the wireless power link by two or more sensor power lines connected to the tubular portion coil. Power may then be transferred between the probe assembly and each of the plurality of tubular portion mounted sensors using the single wireless power link. Alternatively, the tubular portion may comprise a plurality of tubular portion coils and probe coils forming a plurality of wireless power links to which the plurality of tubular portion mounted sensors are connected.

The one or more sensors may be selected from a list including inclinometers, array sensors, accelerometers, internal pressure transducer, annulus pressure transducer, gamma, azimuthal gamma, micro hop Tx, power hop Tx short hop receiver, torque, stretch and other drilling dynamics sensors.

Accordingly the subassembly of the present invention may comprise one or more additional wireless power links for transferring electrical power between a probe assembly and one or more additional sensors supported by a tubular portion of the subassembly. The additional wireless power links may be provided in isolation from the primary wireless power link, and one another. Alternatively, the additional wireless power links may be provided in a linked arrangement with the primary power link, and one another. For example, the wireless power links may be provided in the form of a linear, or daisy chain, configuration. As another alternative or additional example, the wireless power links may be provided in the form of a branched, or star, configuration. This may advantageously provide one or both of flexibility and versatility to the system.

Data obtained by the one or more external sensor mounted on or in the outer wall of the tubular portion, may be stored in an electronic memory in said sensor electronics or in the tubular portion electronics, and retrieved and analysed only after the collar and drill string have been removed from the wellbore. Alternatively, data may be transferred from the sensors to the surface, whilst the sensors remain in the wellbore, so that the data can be analysed on a more real-time basis. For example, a separate communications link may be provided to allow for said data to be transmitted to the surface. The separate communications link may comprise a wireless communications link provided by a one or more additional sets of collar and probe assembly coil arrangements. Such coil arrangements should be preferably spaced from the coils of the (primary) wireless power link to avoid interference.

Alternatively, in some preferred embodiments, the wireless power link of the present invention may be configured to additionally provide a wireless communication link between the one or more mounted sensors and a receiver on the probe assembly or surface. This could operate bi-directionally so that instructions could be sent to the sensors from the probe coil, as well as measurements being sent back by the tubular portion coil.

Preferably, the wireless communication link comprises at least some data transfer from the tubular portion coil to the probe coil. That is, preferably the wireless communication link is arranged to transfer at least some data from one or more sensors mounted on the tubular portion to a receiver on the probe assembly or surface via the tubular portion coil and the probe coil. This can be used to transfer data from one or more sensors mounted on the tubular portion to a receiver on the probe assembly or surface.

Preferably, the signal driving the probe coil is configured to include at least one interruption, and the tubular portion coil is configured to transmit at least some data to the probe coil during the at least one interruption. This may advantageously ensure that there is always sufficient power at the tubular portion for obtaining data from the one or more sensors, and for transmitting said data to the probe coil. This may also allow for data to be transferred at select times, by instigating the data transfer with the power signal driving the probe coil. Data transfer from the tubular portion coil to the probe coil during the at least one interruption may be provided in one or more of the forms described in more detail below with reference to arrangements in which the signal driving the probe coil is configured to include a series of short interruptions of at least two predefined different durations.

In preferred embodiments, the signal driving the probe coil is configured to include a series of short interruptions of at least two predefined different durations. This may be used to convey binary data from the probe assembly to the tubular portion assembly. The data may be obtained at the tubular portion by measuring the duration of each interruption in the signal and recording this as a binary code. In more detail, the signal driving the probe coil may be configured to include a series of short interruptions of predefined different durations, such as an interruption duration of 100 microseconds and an interruption duration of 200 microseconds. These could be registered at the drill collar circuitry as representing a "1" and a "0" respectively, and therefore could be used to represent a binary instruction code for the collar circuitry and one or more sensors.

Alternatively or in addition, the tubular portion coil could send data to the probe coil in the form of a short burst of oscillation in the tubular portion coil signal during one of the power interruptions, or by the tubular portion circuitry switching in an extra load for a short time to signify a "1". This would then be detected at the probe transmitter circuitry and decoded to determine the content of the data received. Data transfer via the short burst of oscillation from the tubular portion coil may be achieved in a number of ways. For example, data transfer may be achieved by amplitude modulation. In this case, the amplitude of the oscillation can be varied between two defined states to indicate either a "0" or a "1". As another example, data transfer may be achieved by frequency modulation. In this case, one or more additional resonating capacitors can be included to enable the frequency of the oscillation to be switched between two defined states to indicate either a "0" or a "1". As a further example, the relative length of the short burst of oscillation could be used as a way for conveying data. That is, a short burst of oscillation could be used to indicate a "0" and a long burst of oscillation could be used to indicate a "1", or vice versa. As a yet further example, data transfer could simply be achieved by the presence or absence of a short burst of oscillation in the tubular portion coil signal during one of the power interruptions. In this case, a short burst of oscillation could be used to indicate a "0" and the absence of a burst of oscillation could be used to indicate a "1", or vice versa. This yet further example of data transfer may be particularly advantageous because it can allow for the generation of clear signals with efficient data transfer, without requiring the inclusion of significant additional circuitry.

It will be appreciated that each of the above described examples may be used in combination with one or more of the other the above described examples. Frequency modulation could therefore be used in combination with amplitude modulation, and so forth.

This received data could then be stored in a memory at the probe assembly, or transmitted back to the surface by a further communication link, such as pulser or EM telemetry. Such a system would allow for a sufficient data rate of at least about 1 kBit per second, without compromising the effectiveness of the primary power transfer function of the tubular portion coil and probe coil arrangement.

As an alternative or additional way of transferring data from the tubular portion coil to the probe coil, the resonant circuit of the power receiver electric circuitry of the tubular portion coil may be configured to receive an increased or decreased load shortly after the end of an interruption in the signal driving the probe coil.

This could be achieved, for example, by including a load resistor in the circuitry. The resulting change in load could then be detected in the transmitter of the probe coil, for example, by measuring the current in the probe coil. This could then be used to indicate a state corresponding to either a "0" or a "1", and thus allow for data to be transferred from the tubular portion coil to the probe coil.

The increased or decreased load may be synchronised to a variation in either amplitude or frequency in the signal driving the probe coil, such that the load change can be used to convey data between the tubular portion coil and the probe coil.

As a yet further alternative or additional way of transferring data from the tubular portion coil to the probe coil, the power receiver electric circuitry of the tubular portion coil may be configured to drive the tubular portion coil with an impulse during one of the interruptions in the signal driving the probe coil to generate a passive decaying sinusoidal oscillation. The impulse in the tubular portion coil may be generated by charging a resonant capacitor in the power receiver electric circuitry of the tubular portion coil discharging the resonant capacitor across the tubular portion coil. This can result in a burst of sinusoidal oscillation across the tubular portion coil with an amplitude that decays exponentially. Such oscillation may be detected at the probe transmitter circuitry and decoded to determine the content of the data received. According to a second aspect of the present invention, there is provided a method of transferring power in a subassembly for a bottom hole assembly of a drill string, the method comprising the steps of: providing a subassembly comprising: a tubular portion having a wall for supporting one or more sensors and an inner surface defining a longitudinal bore; a probe assembly comprising a main body, the probe assembly being removably located in the bore and positioned such that a flow channel for drilling fluid is defined between the inner surface of the tubular portion and the probe assembly; and a wireless power link for transferring electrical power between the probe assembly and a sensor supported by the tubular portion, the wireless power link including: a probe coil forming part of the probe assembly and connectable to a probe power source line; a first magnetic flux guide disposed between the probe coil and the main body of the probe assembly; a tubular portion coil forming part of the tubular portion and connectable to a sensor power line; and a second magnetic flux guide disposed between the tubular portion coil and the wall of the tubular portion; forming an inductive circuit between the probe coil and the tubular portion coil; transferring electrical power across the flow channel to the tubular portion coil by driving the probe coil as a transmitter coil; and transferring electrical power from the tubular portion coil to the sensor power line.

The advantages of the method according to the second aspect of the invention are substantially the same as described above for the collar of the first aspect.

Preferably, the tubular portion coil is connected to a power receiver electric circuitry configured to operate the tubular portion coil as a receiver coil, and the power receiver electric circuitry of the tubular portion coil comprises a resonant circuit. In such embodiments, the method may further comprise the step of: using the resonant circuit to tune the tubular portion coil to a drive frequency of the probe coil.

Sensors used in a wellbore environment may not be required to operate continuously. Instead, measurements may only be needed at certain intervals, and as a result, such sensors can reside in a power off state for a large proportion of the time that the collar and drill string are in the wellbore. Consequently, power may only need to be supplied to the sensors in short intervals, with little or no power being stored at the sensors.

As such, in some preferred embodiments, the step of driving the probe coil as transmitter coil is performed for a duration of less than one second, more preferably of less than 0.1 seconds. This can help to minimise the power consumption of the system. This is particularly advantageous when the power source that supplies power to the power source line is the likes of a battery in the probe assembly, since it will reduce the likelihood of needing to retrieve the probe assembly from the wellbore.

Features described in relation to one or more aspects may equally be applied to other aspects of the invention. In particular, features described in relation to the apparatus of the first aspect may be equally applied to the method of the second aspect, and vice versa.

The invention is further described, by way of example only, with reference to the accompanying drawings in which.

Figure 1:
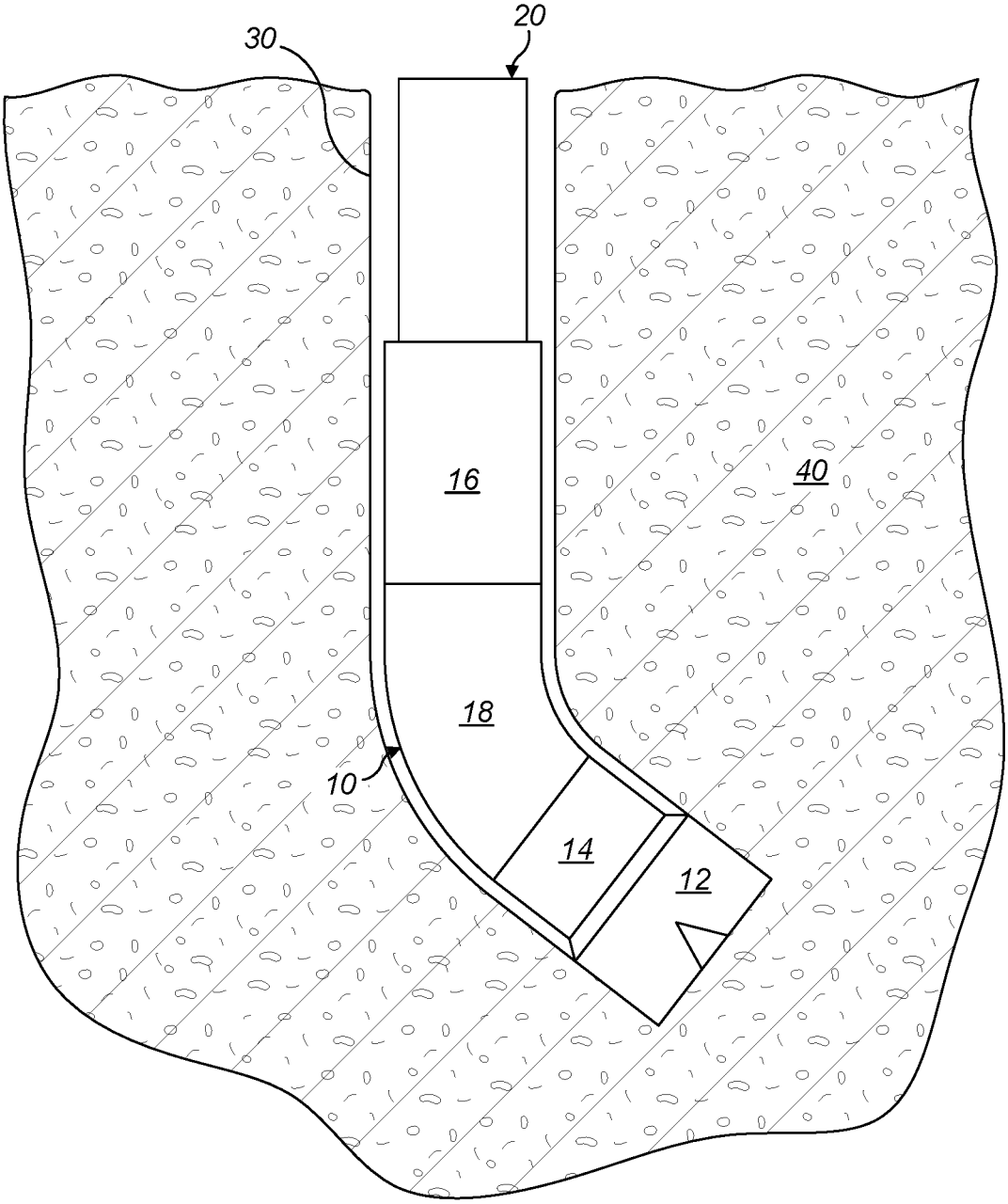
FIG. 1 shows a schematic view, partly in cross-section, of a drilling apparatus including a bottom hole assembly disposed in a subterranean well.

Referring to FIG. 1, a drilling apparatus including a subassembly according to the present invention is shown. The drilling apparatus includes a bottom hole assembly 10 located at the lower end of a drill string 20 which extends from a drilling platform (not shown) at the surface to the bottom hole assembly 10. The bottom hole assembly 10 includes a drill bit 12 at is lower end and a power section and drill motor 14 above the drill bit 12. In use, drilling fluid, or "drilling mud", is pumped from the surface to the bottom hole assembly through the drill string 20. The power section 14 acts as a turbine to extract power from the flow of drilling mud to rotate the drill bit 12. In this manner, the drill bit 12 forms a wellbore 30 through the formation material 40 in which the drill string 20 is located. The bottom hole assembly 10 also includes a number of drill collars 16, which add mass to the bottom hole assembly 10 and which define a central bore through which the drilling mud may be pumped to the power section 14. The bottom hole assembly 10 also includes a tool string 18 comprising a number of individual tool collars connected together. The other tools may include one or more measurement while drilling (MWD) and logging while drilling (LWD) tools. A communications bus (not shown) may run the entire length of the tool string 18 to allow communications with the various tools along the tool string and to allow data to be transmitted from the tools towards the surface.

Figure 2:
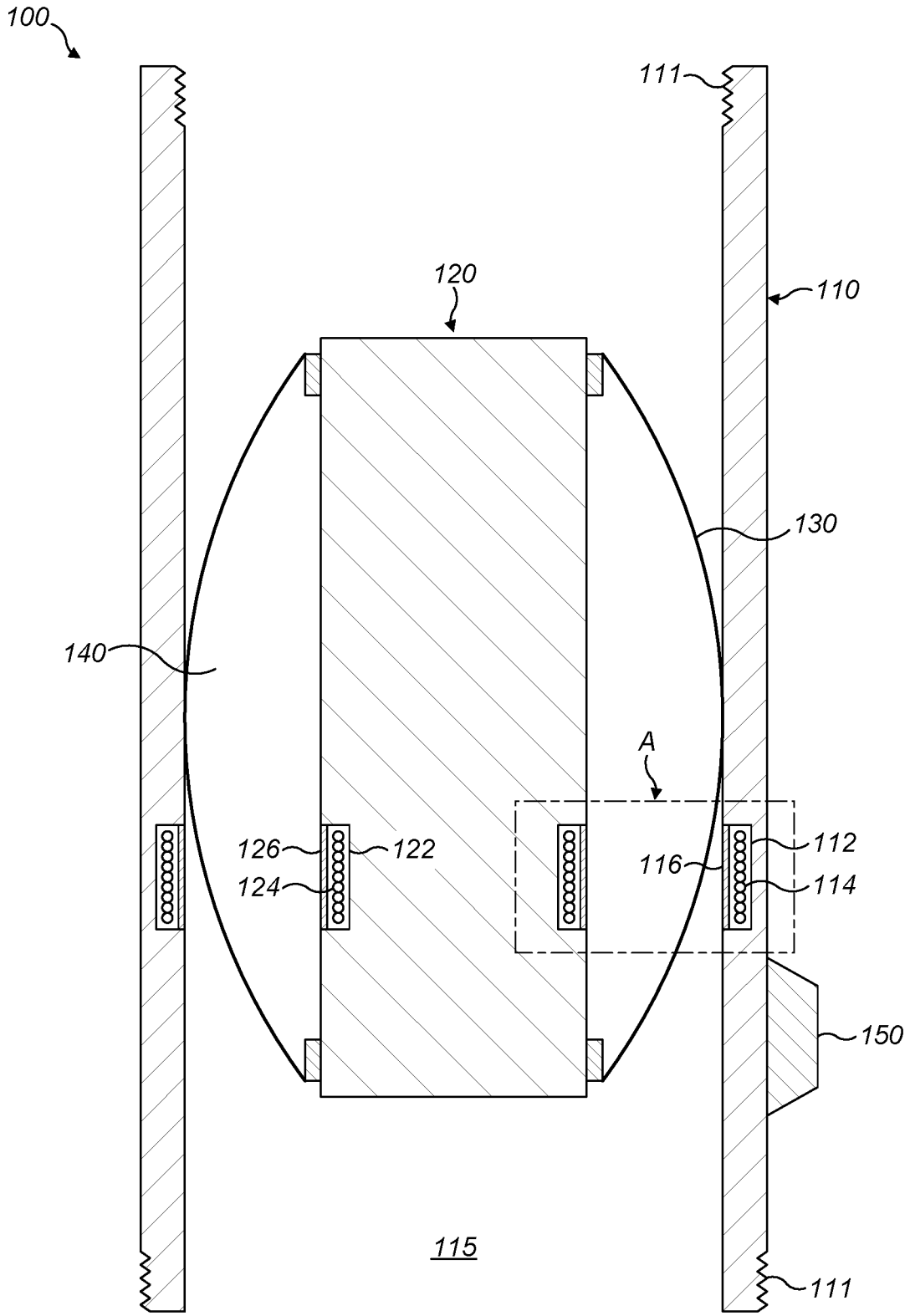
FIG. 2 shows a schematic cross-section of a first embodiment of subassembly for the bottom hole assembly in FIG. 1.

Referring to FIG. 2, a first embodiment of subassembly 100 for the bottom hole assembly of FIG. 1 is shown. The subassembly 100 includes a tubular portion 110 in the form of a collar 110 having a longitudinal bore 115, and a probe assembly 120 comprising one or more instruments, which are removably located in the longitudinal bore 115. The one or more instruments may include pressure pulsers for communication to the surface, directional sensors, gamma sensors, vibration sensors, control electronics, centralizers, batteries, control electronics and retrieval assemblies. The tubular portion 110 includes threaded connections 111 at its upper and lower ends by which the subassembly 100 may be connected to other components in the drill string. In this example, the probe assembly 120 is suspended within the tubular portion 110 by centralisers 130 in the form of metal bow springs, rubber standoffs or other means. The centralisers 130 are fixed to the probe assembly 120 and press against the inner wall of the tubular portion 110 to temporarily seat and stabilize the probe assembly 120 within the bore 115. This arrangement allows the probe assembly to be removed from above while preventing downward movement or rotation of the probe assembly 120 about the central axis of the subassembly 100. When the probe assembly 120 is located within the bore 115, an annular flow space 140 is defined in the section of the bore 115 between the inner wall of the tubular portion 110 and the probe assembly 120 to allow the flow of drilling mud through the subassembly 100 around the probe assembly 120. One or more collar-based sensors 150 are mounted on the outer wall, internal wall or with-in the walls of the drill collar tubular portion 110 to obtain measurements directly from the wellbore or their position in the wellbore or drill string. In this example, the sensor 150 is mounted on the outer surface of the collar 110. In other examples, the sensor 150 or sensors may be mounted on the inner surface of the collar, or in the wall of the collar. The measurements obtained from the sensor 150 are communicated to the probe assembly 120 using a wireless communications link. The wireless communications link may also allow two-way data transfer so that the probe assembly may communicate with the sensor, for example to provide data pertaining to; start-stop signals, configuration changes, pressure data, gamma, inclination, acceration, torque, stretch and others The sensor 150 is supplied with power via a wireless power link, which is formed by a first induction coil 112, or "tubular portion coil", provided on the tubular portion 110 and a second induction coil 122, or "probe coil", provided on the probe assembly 120.

The tubular portion coil 112 is wound in a radial recess or groove 114 formed in and circumscribing the inner surface of the tubular portion 110. Similarly, the probe coil 122 is wound in a radial recess or groove 124 formed in and extending around the outer surface of the main body of the probe assembly 120. To allow the grooves 114, 124 to be sealed against drilling mud, a non-magnetic cover 116, 126 is provided over the opening of each of the grooves 114, 124. To assist the covers 116, 126 with sealing against drilling mud, the grooves 114, 124 may also contain oil, although this is not considered to be essential.

Figure 3:
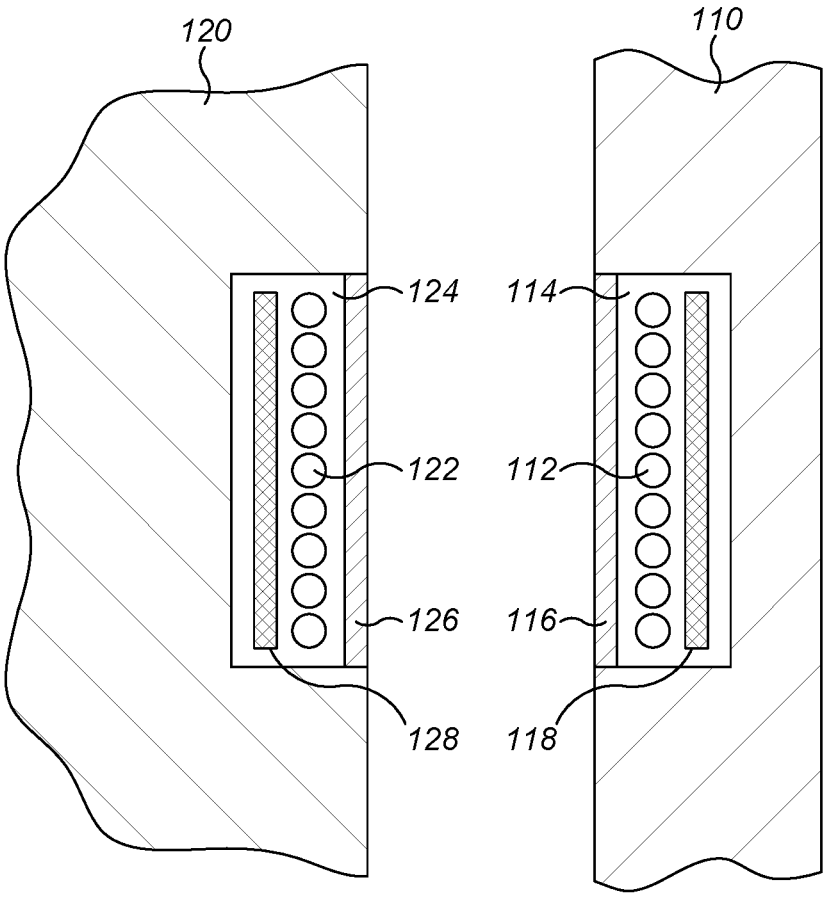
FIG. 3 shows an enlarged cross-section of detail A in FIG. 2.

As seen from the enlarged view in FIG. 3, the wireless power link also includes a first magnetic flux guide 128 of ferrite material, and a second magnetic flux guide 118 of ferrite material. The first magnetic flux guide 128 is disposed between the outer surface of the main body of the probe assembly 120 and the probe coil 122. The second magnetic flux guide 118 is disposed between the tubular portion coil and the inner surface of the tubular portion 110.

Referring again to FIG. 3, the coils 114, 124 are wound in their respective radial grooves 112, 122 such that the space between the coils and the inner surfaces of the grooves is occupied by the respective flux guides.

Figure 4:
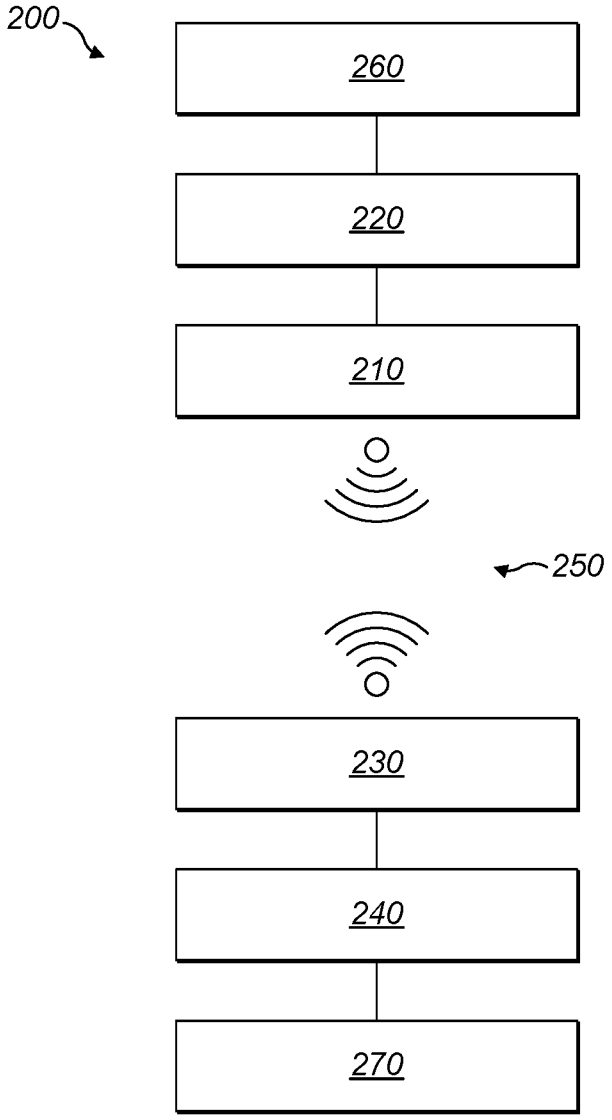
FIG. 4 shows a schematic illustration of the wireless power link in the subassembly of FIG. 2

Referring to FIG. 4, the wireless power link 200 of the subassembly 100 is shown. The wireless power link 200 includes a transmitter coil 210 connected to transmitter electric circuitry 220 and a receiver coil 230 connected to receiver electric circuitry 240. The transmitter coil 210 and the receiver coil 230 are inductively coupleable to form an inductive circuit 250. The transmitter electric circuitry 220 is connected to a power line 260 for providing power to the transmitter coil 210, and the receiver electric circuitry 240 is connected to power line 270 for onward transfer of power from the receiver coil 230. Both the probe assembly with transmitter coil and the tubular portion assembly with receiver coil are preferably powered by the same set of batteries or power generators within the probe or collar assemblies.

In this embodiment, both the tubular portion coil and the probe coil are operable as the transmitter coil and as the receiver coil.

In other words, two sets of transmitter electric circuitry 220 and receiver electric circuitry 240 are provided, with the tubular portion coil and the probe coil each connected to one transmitter electric circuitry 220 and one receiver electric circuitry 240. In this manner, there may be a transfer of power from the probe assembly to the tubular portion equipment, as well as a two-way transfer of data between the probe assembly and the tubular portion equipment. However, for the purpose of clarity, FIG. 4 shows only one set of transmitter electric circuitry 220 and receiver electric circuitry 240. In other examples, where only one-way power transfer is required, the wireless communications link may include only one set of transmitter electric circuitry 220 and one set of receiver electric circuitry 240.

Figure 5:
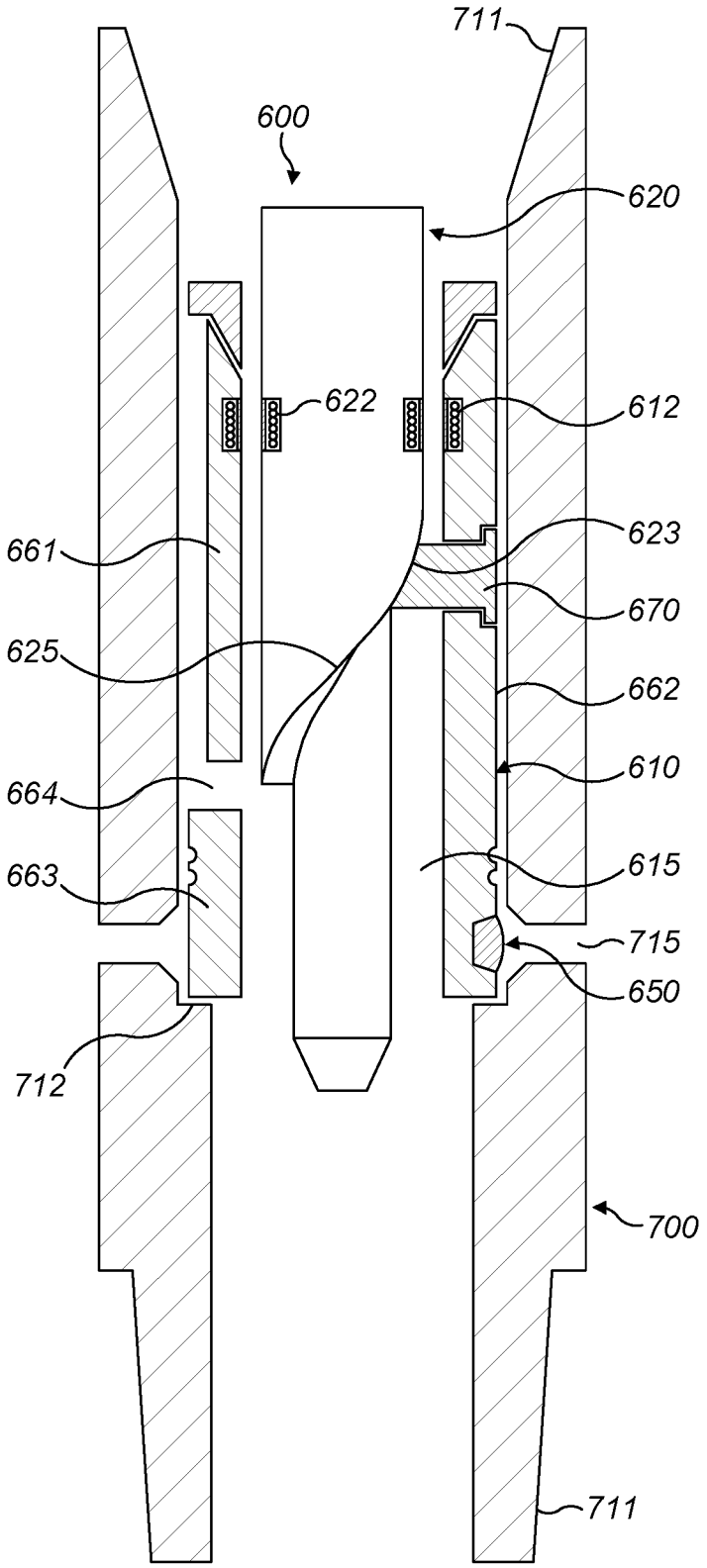
FIG. 5 shows a sectional view of a second embodiment of subassembly for the bottom hole assembly in FIG. 1.
Figure 6:
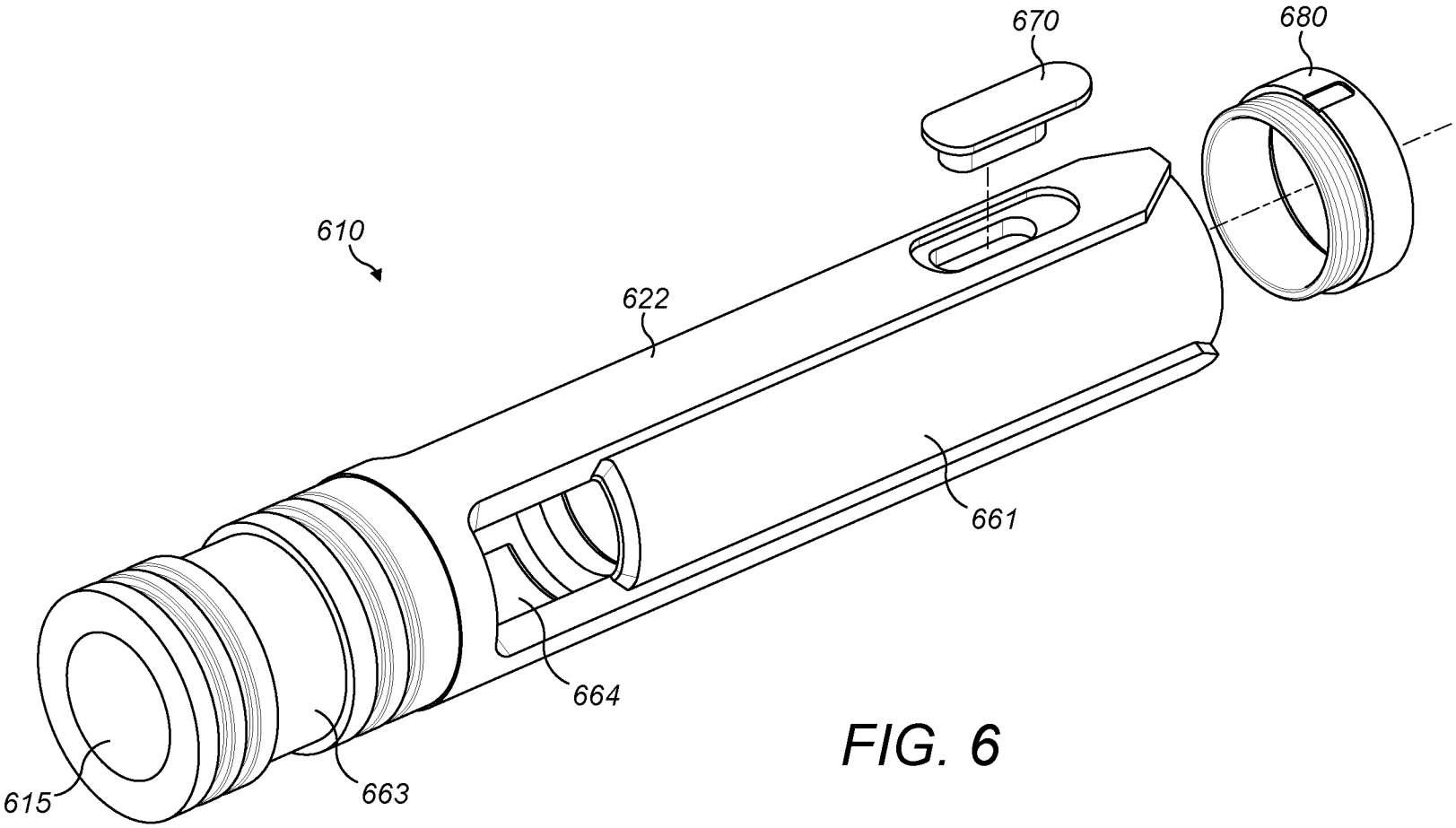
FIG. 6 shows an exploded perspective view of the tubular portion of the subassembly of FIG. 6.

Referring to FIGS. 5 and 6, a second embodiment of subassembly 600 for the bottom hole assembly of FIG. 1 is shown. The subassembly 600 includes a tubular portion in the form of a sleeve 610 having a longitudinal bore 615, and a probe assembly 620 removably located in the longitudinal bore 615. As shown in FIG. 5, the sleeve 610 is arranged for insertion into a collar 700 forming part of the length of the bottom hole assembly. In this example, the sleeve 610 is a mule shoe and the collar is a universal bottom hole orientation (UBHO) sub within which the mule shoe 610 is held. The collar 700 includes threaded connections 711 at its upper and lower ends by which it may be connected to other components in the drill string.

The mule shoe sleeve 610 has a cylindrical portion 661 with a smaller outer diameter than the inner diameter of the collar 700 and has plurality of ribs 662 extending along the length of the cylindrical portion 661 and terminating in an annular portion 663 at the downhole end of the sleeve 610. The ribs 662 engage with the inner surface of the collar 700 and the annular portion 663 abuts against a shoulder 712 in the collar 700. An aperture 664 is provided between the cylindrical portion 661 and the annular portion 663 so that the outside of the cylindrical portion 661 between adjacent ribs 662 is in fluid communication with the bore of the annular portion 663. The sleeve 610 further includes a key 670 extending through the thickness of the sleeve 610 and projecting into the bore 615 defined by the cylindrical portion 661. A replaceable wear ring 680 is screwed onto the upstring end of the sleeve 610.

The probe assembly 620 is substantially the same as the probe assembly of the first embodiment. However, the probe assembly 620 of the second embodiment further includes a longitudinally extending slot 623 on the outer surface of its main body for receiving the key 670 and has an angled guide surface 625 which leads to the entrance of the slot 623.

Before the collar is connected to the drill string, the sleeve 610 is axially inserted into the bore of the collar 700 so that the annular portion 663 abuts against the shoulder 712. The sleeve 610 is then held in position within the collar 700 by setscrews (not shown) that extend through ports 713 in the collar 700 to clamp down on the sleeve 610. Once the sleeve 610 is in position, the probe assembly 620 is inserted into the bore 615 of the sleeve 610 until the key 670 engages with the slot 623 on the outer surface of the probe assembly 620. If required, rotational position of the probe assembly 620 is corrected during insertion be the engagement of the key 670 with the guide surface 625 on the probe assembly 620. Thus, as with the first embodiment, the probe assembly 620 is suspended within the tubular portion 610 such that rotation and further downward movement of the probe assembly 620 is prevented. As with the first embodiment, the probe assembly 620 may be easily retrieved from above.

When the probe assembly 620 is located within the bore 615, an annular flow channel 640 is defined in the section of the bore 615 between the inner surface of the sleeve 610 and the probe assembly 620 to allow the flow of drilling mud through the sleeve 610 around the probe assembly 620. Drilling mud may also pass along the outside of the cylindrical portion 661 between adjacent ribs 662 and through the bore in the annular portion 663 via the aperture 664. A sensor (not shown) is attached to the lower end of the sleeve 610 and may be in fluid communication with the wellbore to allow the sensor to obtain measurements directly from the wellbore. The sensor is connected to the tubular portion coil 612 via a sensor power line (not shown). The sensor may therefore be powered by the tubular portion coil 612, which in turn may receive power from the probe coil 622. As with the first embodiment of FIG. 2, the embodiment of FIGS. 5 and 6 includes first and second magnetic flux guides between the coils and their respective tubular portion and probe assembly; however, for clarity of drawing, these are not visible in FIG. 5 or 6.

Figure 7A:
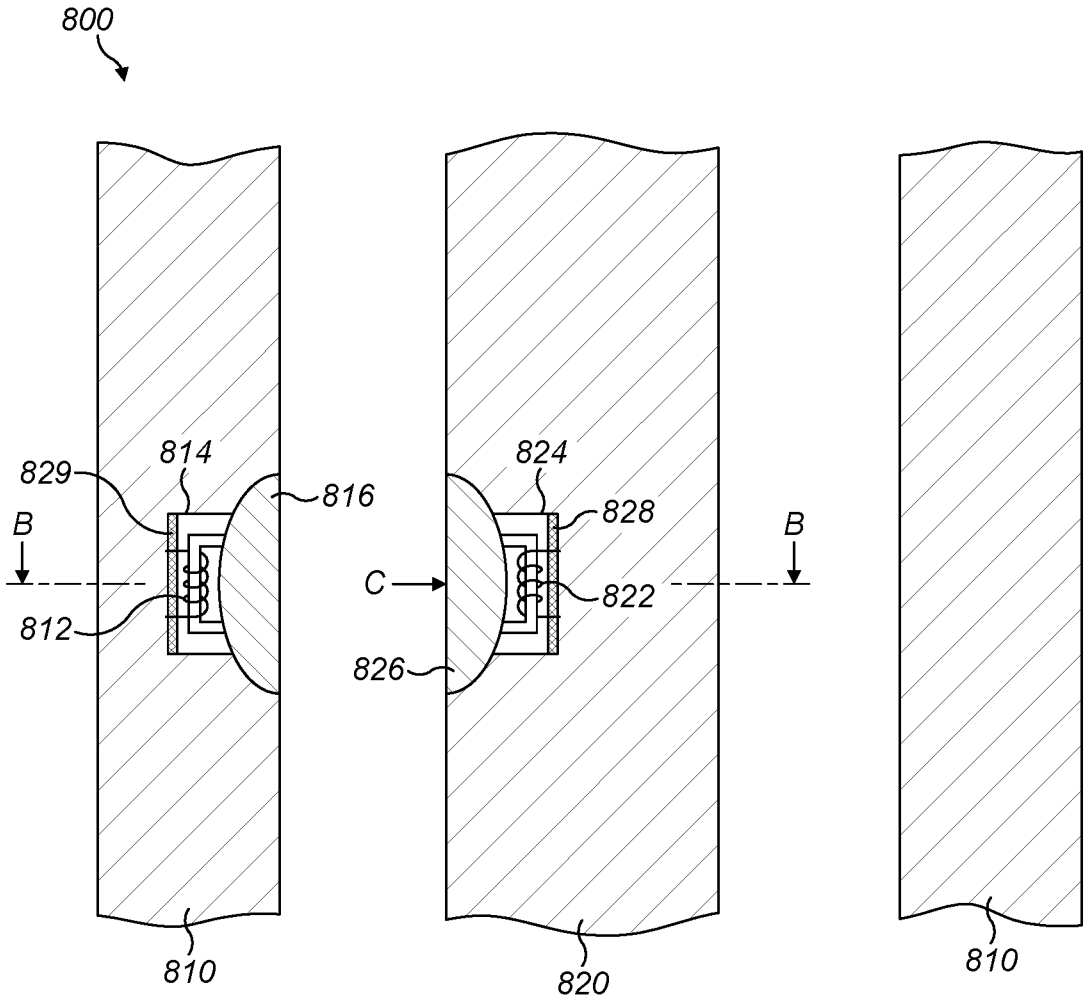
FIG. 7A shows a sectional view of a third embodiment of subassembly for the bottom hole assembly of FIG. 1.
Figure 7B:
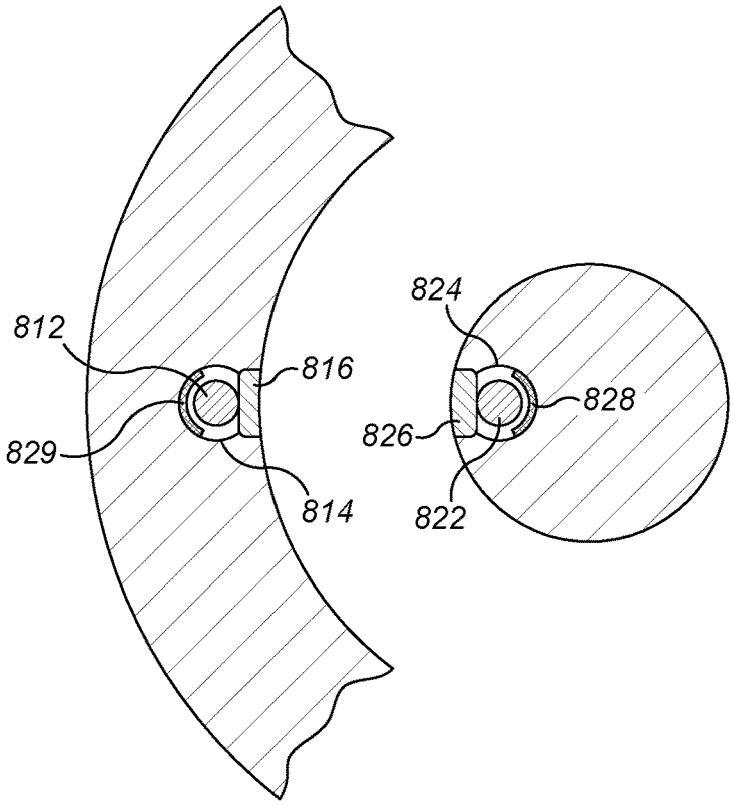
FIG. 7B shows a transverse cross-sectional view of the subassembly of FIG. 7A taken through line B-B.
Figure 7C:
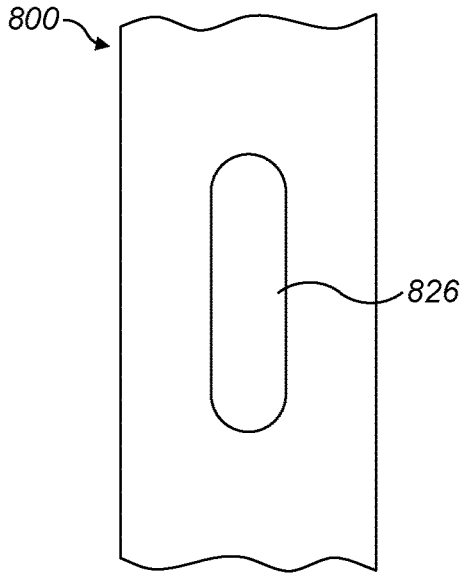
FIG. 7C shows a side view of the probe assembly of the subassembly of FIG. 7A in the direction of arrow C.

Referring to FIGS. 7A to 7C, a third embodiment of subassembly 800 for the bottom hole assembly of FIG. 1 is shown. The subassembly 800 of the third embodiment is similar in construction and operation to first embodiment of subassembly 100, and where the same features are present, like reference numerals have been used. However, in the third embodiment of subassembly 800, the tubular portion coil 812 is wound around a core located within a recess 814 formed on the inner surface of the tubular collar 810 only on one side of the tubular collar 810, and the probe coil 822 is wound around a core located within a recess 824 formed only on one side of outer surface of the main body of the probe assembly 820. With this configuration, the magnetic axes of the tubular portion coil 812 and the probe coil 822 are parallel but offset from each other. As with the first embodiment of subassembly 100, a non-metallic cover 816, 826 is provided over the opening of each of the recesses 814, 824. Due to the shape of the recesses 814, 824, it may be easier to form a seal using the covers 816, 826 in comparison to the annular seals of the first embodiment. Furthermore, as with the first and second embodiments, the embodiment of FIGS. 7A-7C includes a first magnetic flux guide 828 disposed between the surface of the recess 824 in the main body of the probe assembly 820 and the probe coil 822, and a second magnetic flux guide 829 disposed between the tubular portion coil 812 and the inner surface of the tubular portion 810 forming the recess 814.

The specific embodiments and examples described above illustrate but do not limit the invention. It is to be understood that other embodiments of the invention may be made and the specific embodiments and examples described herein are not exhaustive.

The invention claimed is:

1. A subassembly for a wellbore, the subassembly comprising:

a tubular portion having a wall for supporting one or more sensors and an inner surface defining a longitudinal bore;

a probe assembly comprising a main body, the probe assembly being removably located in the bore and positioned such that a flow channel for fluid is defined between the inner surface of the tubular portion and the probe assembly; and a wireless power link for transferring electrical power between the probe assembly and the one or more sensors supported by the tubular portion, the wireless power link including:

a probe coil forming part of the probe assembly and connectable to a probe power source line;

a first magnetic flux guide disposed between the probe coil and the main body of the probe assembly;

a tubular portion coil forming part of the tubular portion and connectable to a sensor power line; and a second magnetic flux guide disposed between the tubular portion coil and the wall of the tubular portion;

wherein the probe coil and the tubular portion coil are positioned such that an inductive circuit is formed across the flow space between the probe coil and tubular portion coil to allow power transfer between the probe power source line and the sensor power line using the inductive circuit, wherein the wireless power link is further configured to provide a wireless communication link between the one or more sensors and a receiver on the probe assembly, and wherein a signal driving the probe coil is configured to include at least one interruption, and the tubular portion coil is configured to transmit at least some data to the probe coil during the at least one interruption.

2. The subassembly according to claim 1, wherein the tubular portion coil is connected to a power receiver electric circuitry configured to operate the tubular portion coil as a receiver coil, and/or wherein the probe coil is connected to power transmitter electric circuitry configured to operate the probe coil as a transmitter coil.

3. The subassembly according to claim 2, wherein a resonant circuit is included in one or both of: the power transmitter electric circuitry of the probe coil, and the power receiver electric circuitry of the tubular portion coil.

4. The subassembly according to claim 3, wherein the power receiver electric circuitry of the tubular portion coil comprises a resonant circuit configured to tune the tubular portion coil to a drive frequency of the probe coil.

5. The subassembly according to claim 1, wherein the probe coil is configured to drive the tubular portion coil with a square wave drive signal.

6. The subassembly according to claim 1, wherein the wireless communication link is arranged to transfer at least some data from the one or more sensors supported by the tubular portion to a receiver on the probe assembly via the tubular portion coil and the probe coil.

7. The subassembly according to claim 1, wherein the signal driving the probe coil is configured to include a series of short interruptions of at least two predefined different durations.

8. The subassembly according to claim 1, wherein the tubular portion coil is configured to send data to the probe coil in the form of a short burst of oscillation in the tubular portion coil signal during at least one interruption in the signal driving the probe coil.

9. The subassembly according to claim 1, wherein the amplitude of the driving signal of the probe coil is varied between at least two predefined amplitudes.

10. The subassembly according to claim 1, wherein the amplitude of a driving signal of the probe coil is varied, and such amplitude modulation is used as a means of conveying data from the probe coil to the tubular coil.

11. The subassembly according to claim 1 wherein the frequency of the driving signal of the probe coil is varied between at least two predefined frequencies.

12. The subassembly according to claim 1, wherein the frequency of the driving signal of the probe coil is varied, and such frequency modulation is used to convey data from the probe coil to the tubular coil.

13. The subassembly according to claim 1, wherein the probe coil and the tubular portion coil are both tuned to a frequency of about 200 kHz or less.

14. The subassembly according to claim 1, wherein the one or more sensors are mounted in or on the wall of the tubular portion, and the subassembly further comprising one or more sensor power lines connected to the one or more sensors, wherein the one or more sensors are connected to the tubular portion coil by the one or more sensor power lines such that power may be transferred from the probe assembly power source to each of the one or more sensors using the wireless power transfer link.

15. A method of transferring power in a subassembly for a wellbore, the method comprising the steps of:

providing a subassembly comprising:

a tubular portion having a wall for supporting one or more sensors and an inner surface defining a longitudinal bore;

a probe assembly comprising a main body, the probe assembly being removably located in the bore and positioned such that a flow channel for fluid is defined between the inner surface of the tubular portion and the probe assembly; and a wireless power link for transferring electrical power between the probe assembly and the one or more sensors supported by the tubular portion, the wireless power link including:

a probe coil forming part of the probe assembly and connectable to a probe power source line;

a first magnetic flux guide disposed between the probe coil and the main body of the probe assembly;

a tubular portion coil forming part of the tubular portion and connectable to a sensor power line; and a second magnetic flux guide disposed between the tubular portion coil and the wall of the tubular portion;

wherein the wireless power link is further configured to provide a wireless communication link between the one or more sensors and a receiver on the probe assembly, and wherein a signal driving the probe coil is configured to include at least one interruption, and the tubular portion coil is configured to transmit at least some data to the probe coil during the at least one interruption, forming an inductive circuit between the probe coil and the tubular portion coil; and transferring electrical power across the flow channel to the tubular portion coil by driving the probe coil as a transmitter coil.

16. The method according to claim 15, wherein the tubular portion coil is connected to a power receiver electric circuitry configured to operate the tubular portion coil as a receiver coil, and wherein the power receiver electric circuitry of the tubular portion coil comprises a resonant circuit, and wherein the method further comprises the step of:

using the resonant circuit to tune the tubular portion coil to a drive frequency of the probe coil.

17. The method according to claim 16, wherein the step of driving the probe coil as a transmitter coil is performed for a duration of less than one second.

18. A subassembly for a wellbore, the subassembly comprising:

a tubular portion having a wall for supporting one or more sensors and an inner surface defining a longitudinal bore;

a probe assembly comprising a main body, the probe assembly being removably located in the bore and positioned such that a flow channel for fluid is defined between the inner surface of the tubular portion and the probe assembly; and a wireless power link for transferring electrical power between the probe assembly and the one or more sensors supported by the tubular portion, the wireless power link including:

a probe coil forming part of the probe assembly and connectable to a probe power source line;

a first magnetic flux guide disposed between the probe coil and the main body of the probe assembly;

a tubular portion coil forming part of the tubular portion and connectable to a sensor power line; and a second magnetic flux guide disposed between the tubular portion coil and the wall of the tubular portion;

wherein the probe coil and the tubular portion coil are positioned such that an inductive circuit is formed across the flow space between the probe coil and tubular portion coil to allow power transfer between the probe power source line and the sensor power line using the inductive circuit, wherein the wireless power link is further configured to provide a wireless communication link between the one or more sensors and a receiver on the probe assembly, and wherein the tubular portion coil is configured to send data to the probe coil in the form of a short burst of oscillation in the tubular portion coil signal during at least one interruption in the signal driving the probe coil.

19. A subassembly for a wellbore, the subassembly comprising:

a tubular portion having a wall for supporting one or more sensors and an inner surface defining a longitudinal bore;

a probe assembly comprising a main body, the probe assembly being removably located in the bore and positioned such that a flow channel for fluid is defined between the inner surface of the tubular portion and the probe assembly; and a wireless power link for transferring electrical power between the probe assembly and the one or more sensors supported by the tubular portion, the wireless power link including:

a probe coil forming part of the probe assembly and connectable to a probe power source line;

a first magnetic flux guide disposed between the probe coil and the main body of the probe assembly;

a tubular portion coil forming part of the tubular portion and connectable to a sensor power line; and a second magnetic flux guide disposed between the tubular portion coil and the wall of the tubular portion;

wherein the probe coil and the tubular portion coil are positioned such that an inductive circuit is formed across the flow space between the probe coil and tubular portion coil to allow power transfer between the probe power source line and the sensor power line using the inductive circuit, wherein the wireless power link is further configured to provide a wireless communication link between the one or more sensors and a receiver on the probe assembly, and wherein a power receiver electric circuitry of the tubular portion coil is configured to drive the tubular portion coil with an impulse during at least one interruption in a signal driving the probe coil to generate a passive decaying sinusoidal oscillation.

20. A subassembly for a wellbore, the subassembly comprising:

a tubular portion having a wall for supporting one or more sensors and an inner surface defining a longitudinal bore;

a probe assembly comprising a main body, the probe assembly being removably located in the bore and positioned such that a flow channel for fluid is defined between the inner surface of the tubular portion and the probe assembly; and a wireless power link for transferring electrical power between the probe assembly and the one or more sensors supported by the tubular portion, the wireless power link including:

a probe coil forming part of the probe assembly and connectable to a probe power source line;

a first magnetic flux guide disposed between the probe coil and the main body of the probe assembly;

a tubular portion coil forming part of the tubular portion and connectable to a sensor power line; and a second magnetic flux guide disposed between the tubular portion coil and the wall of the tubular portion;

wherein the probe coil and the tubular portion coil are positioned such that an inductive circuit is formed across the flow space between the probe coil and tubular portion coil to allow power transfer between the probe power source line and the sensor power line using the inductive circuit, wherein the wireless power link is further configured to provide a wireless communication link between the one or more sensors and a receiver on the probe assembly, and wherein a resonant circuit of a power receiver electric circuitry of the tubular portion coil is configured to receive an increased or decreased load synchronised to a variation in either amplitude or frequency in a signal driving the probe coil, such load change being used to convey data between the tubular portion coil and the probe coil.

* * * * *